US007758321B2

(12) United States Patent
Fukano et al.

(10) Patent No.: US 7,758,321 B2
(45) Date of Patent: Jul. 20, 2010

(54) PUMP APPARATUS

(75) Inventors: Yoshihiro Fukano, Moriya (JP); Takamitsu Suzuki, Mitsukaido (JP)

(73) Assignee: SMC Kabushiki Kaisha, Tokyo (JP)

( * ) Notice: Subject to any disclaimer, the term of this patent is extended or adjusted under 35 U.S.C. 154(b) by 1276 days.

(21) Appl. No.: 11/181,980

(22) Filed: Jul. 15, 2005

(65) Prior Publication Data

US 2006/0027606 A1 Feb. 9, 2006

(30) Foreign Application Priority Data

Jul. 21, 2004 (JP) ..... 2004-213599

(51) Int. Cl.
*F04B 9/12* (2006.01)

(52) U.S. Cl. ..... 417/384; 417/375; 417/395

(58) Field of Classification Search ..... 417/395, 417/375, 385, 384
See application file for complete search history.

(56) References Cited

U.S. PATENT DOCUMENTS

| | | | | | |
|---|---|---|---|---|---|
| 3,416,461 | A | * | 12/1968 | McFarland | 417/568 |
| 3,680,981 | A | * | 8/1972 | Wagner | 417/388 |
| 3,769,879 | A | * | 11/1973 | Lofquist, Jr. | 92/84 |
| 3,775,030 | A | * | 11/1973 | Wanner | 417/388 |
| 4,068,982 | A | | 1/1978 | Quarve | |
| 4,828,464 | A | * | 5/1989 | Maier et al. | 417/388 |
| 4,828,646 | A | * | 5/1989 | Chung | 156/511 |
| 4,865,528 | A | * | 9/1989 | Fritsch et al. | 417/388 |
| 4,948,349 | A | * | 8/1990 | Koiwa | 417/383 |
| 5,707,219 | A | * | 1/1998 | Powers | 417/386 |
| 5,779,224 | A | * | 7/1998 | Fukano et al. | 251/331 |
| 7,070,400 | B2 | | 7/2006 | Greter | |

FOREIGN PATENT DOCUMENTS

| | | |
|---|---|---|
| EP | 0227035 | 7/1987 |
| JP | 56-161190 | 12/1981 |
| JP | 57-097085 | 6/1982 |
| JP | 62-102880 | 6/1987 |
| JP | 63-208683 | 8/1988 |
| JP | 01-203672 | 8/1989 |
| JP | 6-81740 | 3/1994 |
| JP | 06-129357 | 5/1994 |
| JP | 9-310678 | 12/1997 |
| JP | 10-47234 | 2/1998 |
| JP | 2000-304005 | 10/2000 |
| WO | WO 91/11616 | 8/1991 |
| WO | WO 98/26180 | 6/1998 |
| WO | WO 02/053914 | 7/2002 |

* cited by examiner

*Primary Examiner*—Devon Kramer
*Assistant Examiner*—Peter J Bertheaud
(74) *Attorney, Agent, or Firm*—Paul A. Guss

(57) ABSTRACT

A pump apparatus comprises a piston, which is provided displaceably along a first chamber formed in a body under the action of a pilot pressure, an indirect medium composed of a non-compressive fluid and which is to be pressed by the piston, and a diaphragm that is flexibly bendable in cooperation with the indirect medium. When the fluid is discharged from a discharge port, a change in volume caused by the displacement of the piston in the axial direction is identical to the change in volume caused by the displacement of the diaphragm in the axial direction.

5 Claims, 4 Drawing Sheets

PUMP APPARATUS

BACKGROUND OF THE INVENTION

1. Field of the Invention

The present invention relates to a pump apparatus, which is capable of always discharging a constant amount of a fluid using a piston that is displaceable in accordance with a pilot pressure.

2. Description of the Related Art

A metering discharge pump has been used for supplying a constant amount of a chemical liquid, paint, washing liquid or the like, for example, in an apparatus for producing a semiconductor or the like, a coating apparatus, and a medical apparatus.

A bellows type pump is used as such a metering discharge pump in many cases, wherein suction and discharge pressures are obtained such that an accordion-shaped bellows, which is installed to surround a drive shaft, is expanded and contracted under the driving action of a motor or the like.

A metering discharge pump according to a conventional technique is disclosed, for example, in Japanese Laid-Open Patent Publication No. 10-47234, wherein a valve housing and a pump housing, in which a first valve unit and a second valve unit are arranged respectively, are provided in an integrated manner.

The metering discharge pump disclosed in Japanese Laid-Open Patent Publication No. 10-47234 is designed such that a drive shaft is displaced in an axial direction under the driving action of a motor, and a forward end of a bellows, which is installed at the forward end of the drive shaft, is displaced within a pump chamber formed in the pump housing. The accordion-shaped bellows, which is arranged in the pump chamber, undergoes a linear reciprocating displacement integrally with the drive shaft, whereby the bellows expands and contracts.

More specifically, a construction is adopted in which suction pressure is generated by contracting the bellows inside the pump chamber, and liquid is sucked from the outside in order to fill the interior of the pump chamber with a predetermined amount of liquid. On the other hand, a discharge pressure is generated by expanding the bellows inside the pump chamber under the displacement action of the drive shaft, and thus liquid is discharged from the pump chamber to the outside.

When the metering discharge pump according to such a conventional technique is used, however, it is feared that pulsations may occur within the fluid, as a result of the expanding and contracting actions of the bellows, when the fluid is discharged from the pump chamber to the outside.

Further, in the industrial field of semiconductor production apparatus and the like, in view of the high cost of the coating liquid (resist solution), it is essential that the flow rate of the fluid be controlled highly accurately when the fluid is discharged.

SUMMARY OF THE INVENTION

A general object of the present invention is to provide a pump apparatus, which is capable of discharging a constant amount of a fluid with high accuracy, and without causing any pulsation in the fluid.

The above and other objects, features, and advantages of the present invention will become more apparent from the following descriptions when taken in conjunction with the accompanying drawings in which a preferred embodiment of the present invention is shown by way of illustrative example.

DESCRIPTION OF THE PREFERRED EMBODIMENTS

Figure 1:
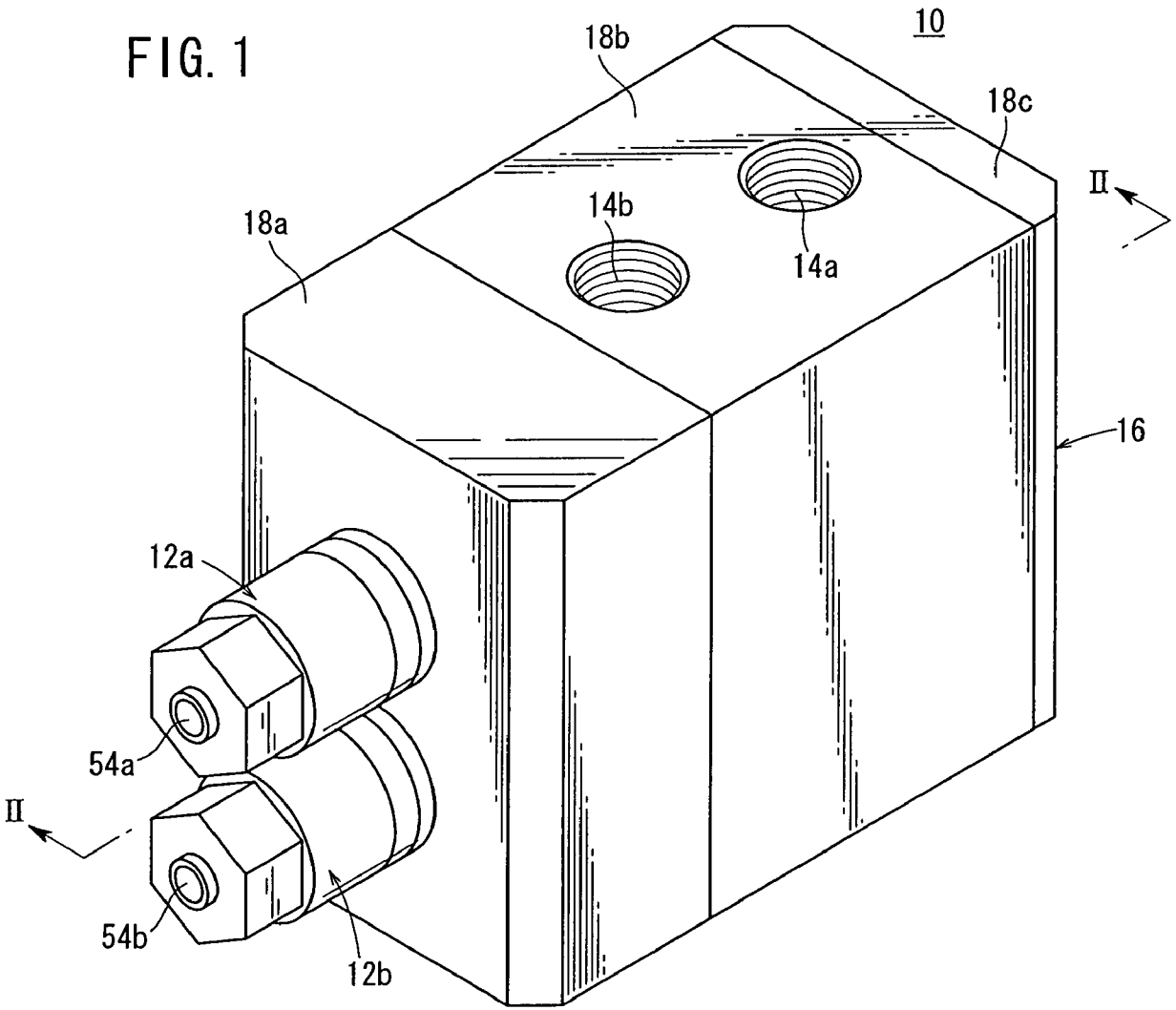
FIG. 1 shows a perspective view, illustrating a metering discharge pump according to an embodiment of the present invention.

With reference to FIG. 1, reference numeral 10 indicates a metering discharge pump according to an embodiment of the present invention.

The metering discharge pump 10 comprises a body 16, which is provided with first and second joint members 12*a*, 12*b* disposed on one side surface, for detachable connection of unillustrated tubes thereto, and a pair of pilot pressure supply ports 14*a*, 14*b*, which are provided on an upper surface of the body 16.

Installation of the body 16 is not limited to being in a lateral layout state, in which the first and second joint members 12*a*, 12*b* are positioned on a side surface thereof and the pair of pilot pressure supply ports 14*a*, 14*b* are positioned on the upper surface, as shown in FIG. 1. For example, a vertical layout state is also possible, in which the first and second joint members 12*a*, 12*b* are positioned along an upper surface, whereas the pair of pilot pressure supply ports 14*a*, 14*b* are positioned on a side surface thereof.

The body 16 is formed from a resin material, in a substantially rectangular parallelepiped shape, and is constructed by integrally assembling a port block 18*a* having first and second joint members 12*a*, 12*b*, an intermediate block 18*b*, and an end block 18*c*, through the aid of an unillustrated tightening means. The connecting portion between the intermediate block 18*b* and the end block 18*c* is sealed in a gas-tight or liquid-tight manner by a first seal member 20, which is installed in an annular groove formed on the end block 18*c*.

Figure 2:
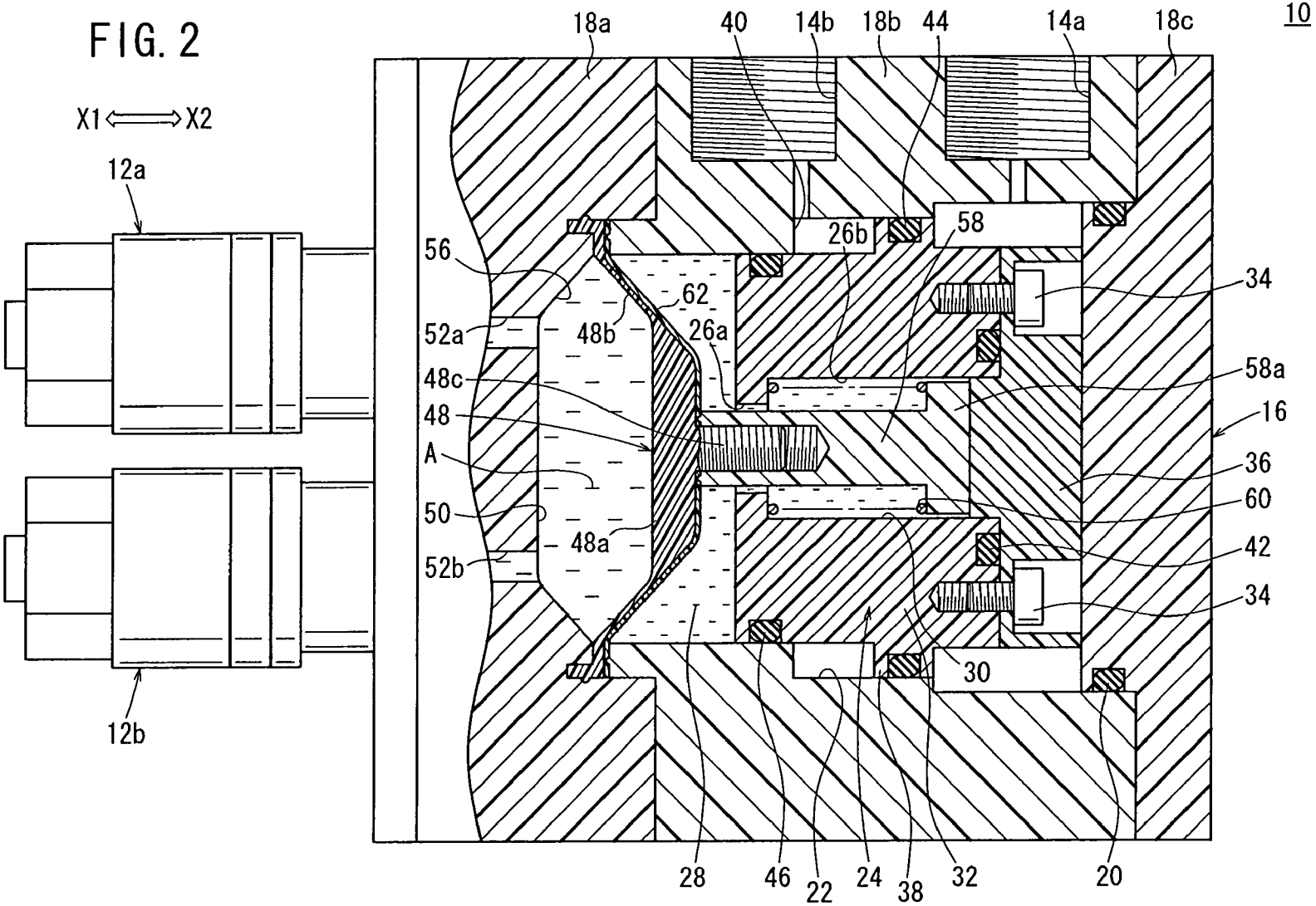
FIG. 2 shows a partial vertical sectional view taken along line II-II shown in FIG. 1.
Figure 3:
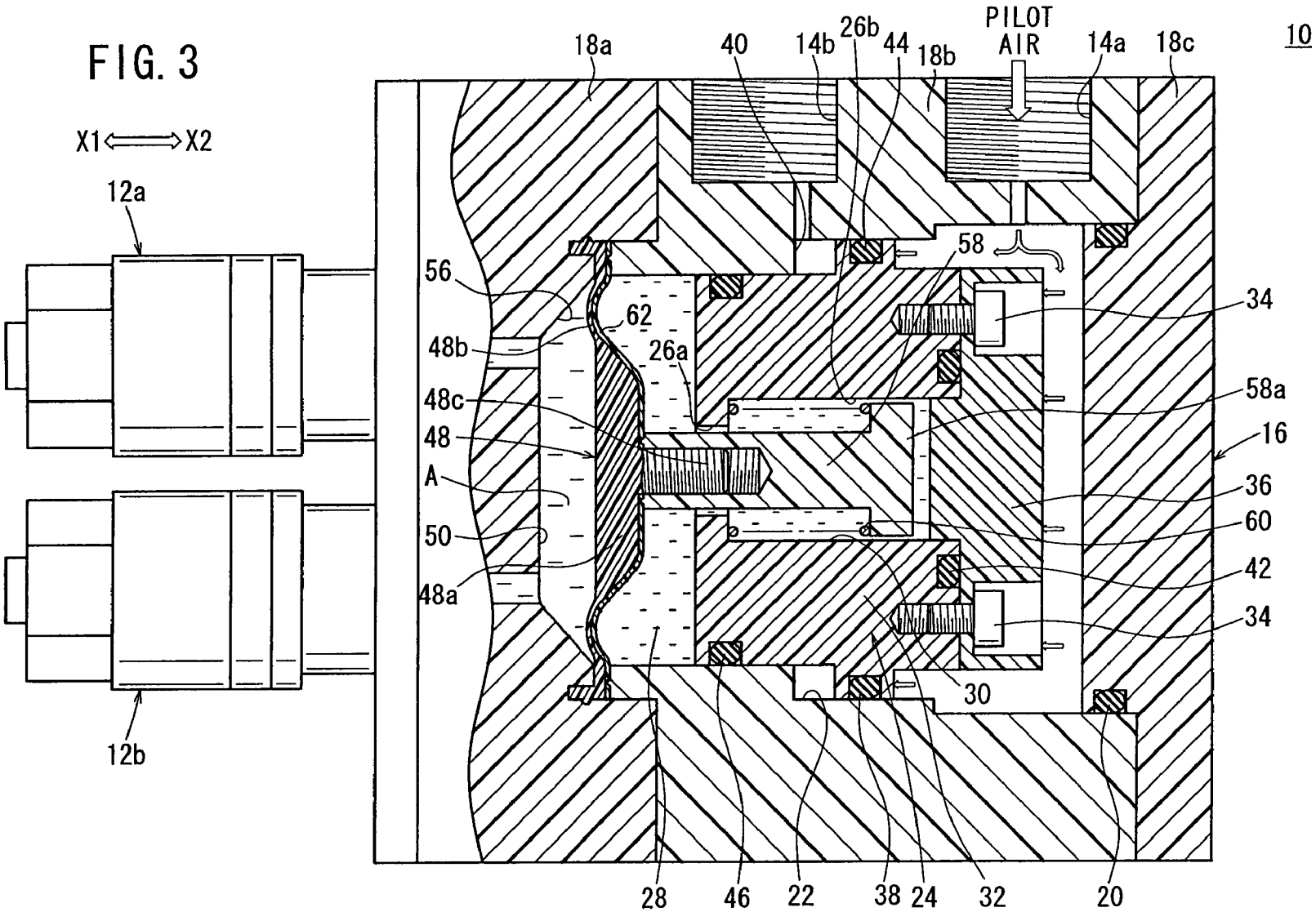
FIG. 3 shows a partial vertical sectional view, illustrating a state in which a piston is displaced under the action of a pilot pressure, starting from the state shown in FIG. 2.
Figure 4:
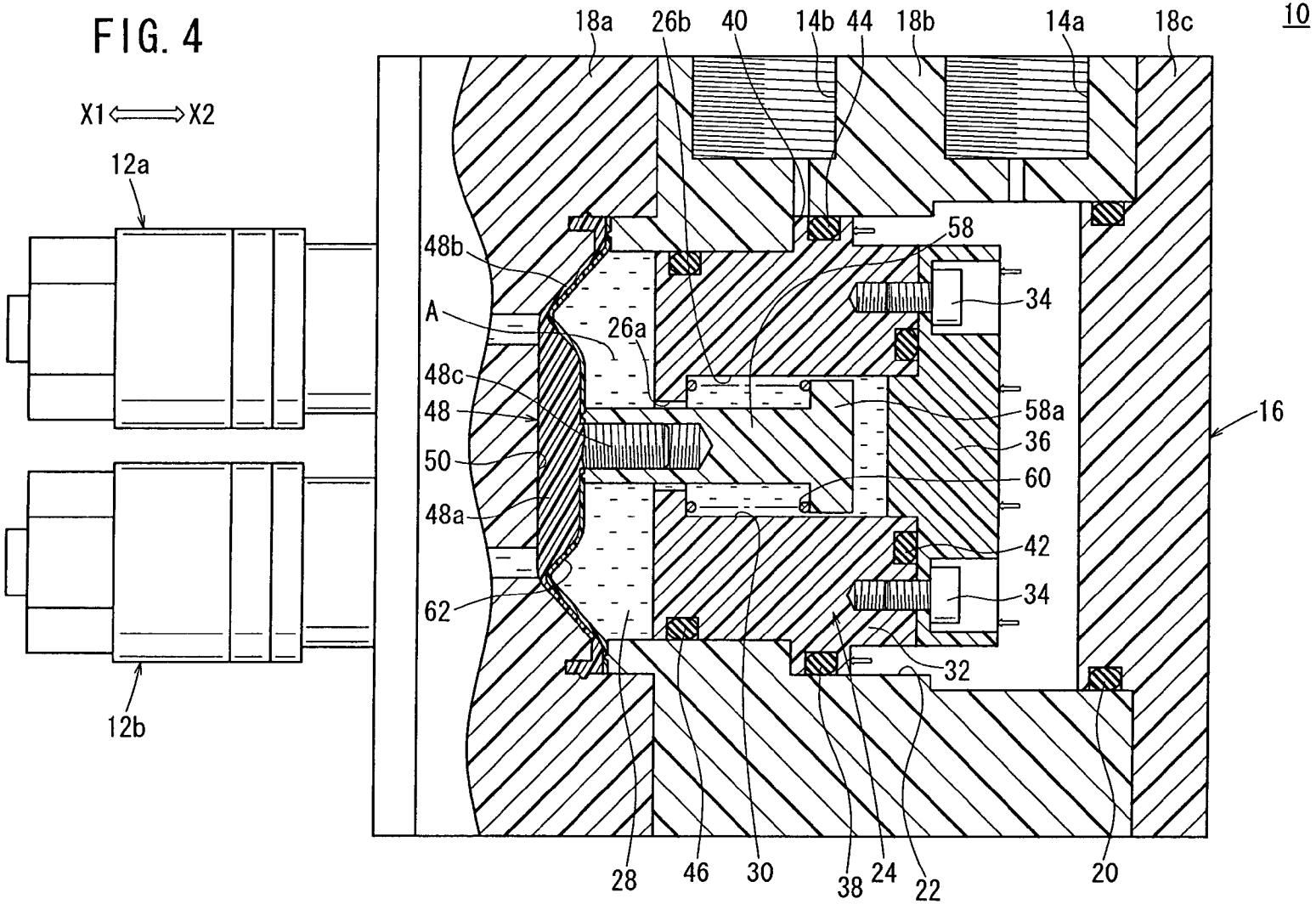
FIG. 4 shows a partial vertical sectional view, illustrating a state in which the piston is further displaced to a terminal end position, starting from the state shown in FIG. 3.

As shown in FIGS. 2 to 4, a first chamber 22 having a circular vertical cross section, which is closed by the port block 18*a* and the end block 18*c*, is formed in the intermediate block 18*b*. A piston 24, which has a circular vertical cross section, is disposed displaceably in the axial direction along the first chamber 22. In FIG. 1, the body 16 is shown as being installed in a lateral layout state. Therefore, in the following description, the axial direction corresponds with the horizontal direction (lateral direction).

The piston 24 includes a main piston body 32, which is composed of a columnar member having a circular cross section, and which has a second chamber 30 formed therein comprising a small diameter hole 26*a* and a large diameter hole 26*b* extending in the axial direction, so that an indirect medium 28 can be introduced as described later on, and a closing plate 36, which closes the second chamber 30 by being integrally connected to one end surface of the main piston body 32 through of a plurality of screw members 34, so that the closing plate 36 is flush therewith. An annular projection 38, which protrudes outwardly by a predetermined length, is formed on the outer circumferential surface of the main piston body 32. The annular projection 38 abuts against an annular step 40, which is formed on the inner wall of the intermediate block 18*b*, and thus the displacement of the piston 24 is limited when the fluid is discharged (see FIG. 4).

A second seal member 42, which retains the connecting portion between the main piston body 32 and the closing plate 36 in a gas-tight or liquid-tight manner, is provided between the main piston body 32 and the closing plate 36. The second seal member 42 appropriately prevents the indirect medium 28, which is introduced into the second chamber 30, from invading into other elements disposed on the side of the pressure-receiving surface of the piston 24. A piston packing 44 is installed in a groove of the annular projection 38 of the main piston body 32. The piston packing 44 slides along the inner wall surface of the intermediate block 18*b*. A third seal member 46 is installed in a groove on the outer circumferential surface of the main piston body 32.

A substantially elliptical diaphragm 48, which is interposed between the port block 18*a* and the intermediate block 18*b*, is stretched inside the body 16. The diaphragm 48 is flexibly and bendably formed, for example, by an elastic material such as urethane rubber. In the present embodiment, a pump chamber 50 is formed between the diaphragm 48 and the inner wall of the port block 18*a*. The pump chamber 50 makes communication with a discharge port 54*a* and a suction port 54*b* (see FIG. 1) that are provided in the first and second joint members 12*a*, 12*b* respectively, via first and second passages 52*a*, 52*b*. The shape of the diaphragm 48 is not limited to a substantially elliptical shape, but may consist of the other shapes including, for example, a circular shape.

Unillustrated check valves are arranged, respectively, in each of the first and second passages 52*a*, 52*b*. A counterflow of fluid from the pump chamber 50 toward the suction port 54*b*, as well as a counterflow of fluid from the discharge port 54*a* toward the pump chamber 50, are avoided appropriately by means of the check valves.

The pump chamber 50 has an inclined surface 56, having diameters that expand gradually toward the diaphragm 48 from the flat surface of the port block 18*a* that is formed with the first and second passages 52*a*, 52*b*.

The diaphragm 48 forms an integral structure, comprising a thick-walled central section 48*a*, a thin-walled circumferential edge section 48*b* that continues from the central section 48*a* and which is fixed to the body 16, and a connecting section 48*c*, which protrudes from the central section 48*a* in the axial direction and which has a male thread formed on an outer circumferential surface thereof.

Further, the diaphragm 48 is provided with a displacement member 58, which is connected to the connecting section 48*c* and which is displaceable integrally with the diaphragm 48. The displacement member 58 passes through the small diameter hole 26*a*, which is formed in the main piston body 32 and which faces the interior of the second chamber 30 of the main piston body 32. A flange section 58*a* is formed on the displacement member 58. A restoring spring 60 also is provided, which has one end fastened to the flange section 58*a* and the other end thereof fastened to the annular step of the main piston body 32.

The restoring spring 60 acts to restore the piston 24 to an initial position, by pressing the displacement member 58 with a spring force when the piston 24 is displaced toward the initial position to suck the fluid.

An indirect medium 28, which is composed of, for example, a non-compressive fluid such as oil, is charged into the space that extends in the axial direction between the diaphragm 48 and the flat end surface of the piston 24 to which the closing plate 36 is not connected. In the present embodiment, the indirect medium 28 is introduced into the space between the diaphragm 48 and the end surface of the piston 24, as well as into the closed second chamber 30 in the main piston body 32 via the clearance between the displacement member 58 and the small diameter hole 26*a* of the main piston body 32, owing to the sealing function effected by the diaphragm 48 and the second and third seal members 42, 46. It is assumed that the indirect medium 28, which is a non-compressive fluid as described above, is charged into the entire space between the piston 24 and the diaphragm 48, and that the indirect medium 28 does not undergo any volume change.

A sheet-like protecting member 62, which is formed, for example, from an elastic material such as urethane rubber to protect the diaphragm 48, is provided between the indirect medium 28 and the diaphragm 48. The protecting member 62 is interposed between the port block 18*a* and the intermediate block 18*b*, in the same manner as the diaphragm 48.

The metering discharge pump 10 according to the embodiment of the present invention is basically constructed as described above. Next, its operation, function, and effect shall be explained. An explanation shall be made assuming that the initial position resides in the state as shown in FIG. 2, in which a predetermined amount of the fluid A has been already sucked into the pump chamber 50, the diaphragm 48 is recessed in a concave form toward the piston 24, and the flange section 58*a* of the displacement member 58 connected to the diaphragm 48 abuts against the closing plate 36 of the piston 24.

At first, for example, an unillustrated semiconductor coating liquid supply source is connected to the suction port 54*b* of the joint member 12*b* via an unillustrated tube. On the other hand, for example, an unillustrated coating liquid-dripping apparatus is connected to the discharge port 54*a* of the joint member 12*a* via another unillustrated tube.

Subsequently, an unillustrated pilot air supply source is energized to supply pilot air to one pilot pressure supply port 14*a*. During this process, the other pilot pressure supply port 14*b* is in a state of being open to atmospheric air. Pilot air is supplied into the space between the piston 24 and the end block 18*c* to press the piston 24 in a direction (i.e., the direction of arrow X1) in which the piston 24 separates from the end block 18*c*, using the pressure-receiving surfaces of the annular projection 38 and the closing plate 36 of the piston 24.

When the piston 24 is displaced in the direction of the arrow X1, the indirect medium 28 is pressed by the flat end surface of the piston 24, and the diaphragm 48 is pressed by the aid of the indirect medium 28. Accordingly, the circumferential edge section 48*b* of the diaphragm 48 is flexibly bent in the displacement direction of the piston 24, in conjunction and in cooperation with the displacement of the piston 24. In this manner, when the diaphragm 48 is flexibly bent, a predetermined amount of the fluid A contained in the pump chamber 50 is discharged to the outside via the discharge port 54*a*.

A comparison shall now be made between the displacement amounts of the diaphragm 48 and the piston 24, respectively, in the axial direction when the piston 24 is pressed by the pilot pressure to be displaced by a predetermined amount. The structure thereof is designed so that the axial displacement amount of the central section 48*a* and the connecting section 48*c* of the diaphragm 48 is larger than the axial displacement amount of the piston 24.

That is, in its initial position, the diaphragm 48, which has an elliptical shape, is recessed in a concave form toward the piston 24, with the outer circumferential edge portion thereof being fixed to the body 16. Therefore, the axial displacement amount of the diaphragm 48 is not identical with that of the piston 24, which has a circular vertical cross section, and the displacement amount of the diaphragm 48 is in fact larger than that of the piston 24.

Therefore, as shown in FIG. 3, when the piston 24 is displaced by a predetermined amount under the action of the pilot pressure, the displacement member 58, which abuts against the closing plate 36 of the piston 24 in its initial position, is displaced by an amount larger than the displacement amount of the piston 24 in the axial direction, and thus is separated from the closing plate 36 by a predetermined distance. Further, the indirect medium 28 is introduced into a space between the closing plate 36 and the displacement member 58.

As a result, displacement of the piston 24 is transmitted to the diaphragm 48 via the indirect medium 28, which is composed of a non-compressive fluid. Accordingly, the flow rate based on displacement of the piston 24 (obtained by multiplying the displacement amount in the axial direction by the pressure-receiving area) is identical to the flow rate (discharge amount) of the fluid A discharged from the pump chamber 50 via the discharge port 54*a*, as a result of being pressed by the diaphragm 48.

In other words, the volume change caused by displacement of the piston 24 in the axial direction in accordance with the action of the pilot pressure (obtained by multiplying the displacement amount in the axial direction by the pressure-receiving area) is identical with the volume change caused by displacement of the diaphragm 48 in the axial direction for discharging the fluid A from the pump chamber 50, owing to the presence of the indirect medium 28 as a non-compressive intervening fluid. Therefore, the discharge amount, which corresponds to the volume change of the piston 24, can be kept constant with high accuracy.

In this embodiment, operations and performance are sufficient, so long as the pilot pressure remains at a constant pressure. Therefore, unlike the conventional technique, it is unnecessary to detect a displacement amount of the piston 24 in order to perform a feedback control of the pilot pressure corresponding to the displacement amount.

The fluid A contained in the pump chamber 50 is discharged to the coating liquid-dripping apparatus, which is connected to the discharge port 54*a* via an unillustrated tube. A constant amount of the fluid A (for example, a coating liquid) is continuously dropped onto the semiconductor wafer. The flow rate of the fluid A can be controlled highly accurately, so that the flow rate of the fluid A discharged from the discharge port 54*a* remains constant, corresponding to a flow rate based on the displacement of the piston 24.

In this arrangement, the pressing force of the piston 24 flexibly bends the diaphragm 48, while the indirect medium 28 provides a non-compressive fluid intervening between the piston 24 and the diaphragm 48. Therefore, the fluid A can be discharged highly accurately, without causing any pulsations in the fluid A.

Further, even when the fluid A that flows into the pump chamber 50 is a liquid, the fluid A does not remain in the pump chamber 50 after the fluid A has been discharged from the pump chamber 50 to the outside. Therefore, formation of liquid pools is avoided, which would otherwise be caused by adhesion of the liquid to the diaphragm 48.

In order to suck the fluid A, after a predetermined amount of the fluid A has been discharged from the discharge port 54*a*, the supply of the pilot air is switched from one pilot pressure supply port 14*a* to the other pilot pressure supply port 14*b*, and the one pilot pressure supply port 14*a* is placed in a state of being open to atmospheric air.

The piston 24 is displaced in the direction of the arrow X2, to restore the piston 24 to the initial position shown in FIG. 1, as a result of the pilot air supplied from the other pilot pressure supply port 14*b*. A predetermined amount of the fluid A is sucked into the pump chamber 50, via the suction port 54*b*, and the process proceeds to the discharge step as described above.

Although certain preferred embodiments of the present invention have been shown and described in detail, it should be understood that various changes and modifications may be made therein without departing from the scope of the appended claims.

What is claimed is:

1. A pump apparatus comprising:

a body, having a suction port for sucking a fluid and a discharge port for discharging said fluid, and wherein a pump chamber is formed in said body;

a piston which is displaceable along a first chamber formed in said body under an action of a pilot pressure;

an indirect medium composed of a non-compressive fluid, wherein said indirect medium is pressed by said piston when said fluid is discharged; and a diaphragm that is flexibly bendable in cooperation with said indirect medium, and which presses said fluid charged in said pump chamber, such that said fluid is discharged in an amount corresponding to a displacement amount of said piston, said pump chamber being defined by said diaphragm, an inclined surface formed in said body, and a flat surface formed in said body, wherein a second chamber is formed in said piston, and said indirect medium can be introduced into said second chamber, wherein a displacement amount of said diaphragm in an axial direction is set to be larger than said displacement amount of displacement of said piston in said axial direction, is set to be identical with a volume change which is caused by displacement of said diaphragm in said axial direction, wherein a displacement member, which is connected to said diaphragm, is disposed so as to be movable back and forth in said second chamber, said diaphragm including a thick-walled central section, a thin-walled circumferential edge section, which continues from said central section and is fixed to said body, and a connecting section, which protrudes from said central section in said axial direction and connects to said displacement member, wherein said indirect medium is charged into a space between said diaphragm and a flat end surface of said piston in said axial direction, and said indirect medium does not move outside of said space and said second chamber, and when said fluid contained in said pump chamber is completely discharged therefrom, said thick-walled central section abuts against said flat surface, and said thin-walled circumferential edge section abuts against said inclined surface, whereby a volume of said pump chamber is reduced substantially to zero.

2. The pump apparatus according to claim 1, wherein a small diameter hole, which makes communication between said second chamber and said first chamber filled with said indirect medium, is formed in said piston.

3. The pump apparatus according to claim 1, wherein said displacement member includes a flange section, and wherein a spring member that presses said displacement member to restore said piston to an initial position is fastened to said flange section.

4. The pump apparatus according to claim 1, wherein said piston has a circular vertical cross section, and said diaphragm has an elliptical vertical cross section.

5. The pump apparatus according to claim 1, wherein an annular projection is formed on an outer circumferential surface of said piston protruding radially outwardly therefrom, and said displacement of said piston is limited by abutment of said annular projection against an annular step formed on an inner wall of said body.

* * * * *

UNITED STATES PATENT AND TRADEMARK OFFICE

CERTIFICATE OF CORRECTION

PATENT NO. : 7,758,321 B2
APPLICATION NO. : 11/181980
DATED : July 20, 2010
INVENTOR(S) : Yoshihiro Fukano It is certified that error appears in the above-identified patent and that said Letters Patent is hereby corrected as shown below:

Column 6, Line 18-63
Claim 1 is corrected to read as follows:

1. A pump apparatus comprising:

a body, having a suction port for sucking a fluid and a discharge port for discharging said fluid, and wherein a pump chamber is formed in said body;

a piston which is displaceable along a first chamber formed in said body under an action of a pilot pressure;

an indirect medium composed of a non-compressive fluid, wherein said indirect medium is pressed by said piston when said fluid is discharged; and a diaphragm that is flexibly bendable in cooperation with said indirect medium, and which presses said fluid charged in said pump chamber, such that said fluid is discharged in an amount corresponding to a displacement amount of said piston, said pump chamber being defined by said diaphragm, an inclined surface formed in said body, and a flat surface formed in said body, wherein a second chamber is formed in said piston, and said indirect medium can be introduced into said second chamber, wherein a displacement amount of said diaphragm in an axial direction is set to be larger than said displacement amount of <u>said piston in said axial direction when said fluid is discharged from said discharge port, and a volume change, which is caused by</u> displacement of said piston in said axial direction, is set to be identical with a volume change which is caused by displacement of said diaphragm in said axial direction, wherein a displacement member, which is connected to said diaphragm, is disposed so as to be movable back and forth in said second chamber, said diaphragm including a thick-walled central section, a thin-walled circumferential edge section, which continues from said central section and is fixed to said body, and a connecting section, which protrudes from said central section in said axial direction and connects to said displacement member, wherein said indirect medium is charged into a space between said diaphragm and a flat end surface of said piston in said axial direction, and said indirect medium does not move outside of said space and said second chamber, and Signed and Sealed this
Eighteenth Day of January, 2011

David J. Kappos

David J. Kappos
*Director of the United States Patent and Trademark Office* when said fluid contained in said pump chamber is completely discharged therefrom, said thick-walled central section abuts against said flat surface, and said thin-walled circumferential edge section abuts against said inclined surface, whereby a volume of said pump chamber is reduced substantially to zero.